United States Patent [19]

Van Benschoten

[11] Patent Number: 4,852,741

[45] Date of Patent: Aug. 1, 1989

[54] PORTABLE TABLE TOP SALAD BAR

[76] Inventor: Doris G. Van Benschoten, 6 Parker Ave., Poughkeepsie, N.Y. 12601

[21] Appl. No.: 199,447

[22] Filed: May 27, 1988

[51] Int. Cl.[4] ..... B65D 1/34; G55D 6/04

[52] U.S. Cl. ..... 206/558; 220/4 F; 220/DIG. 6; 220/404; 220/354

[58] Field of Search ..... 206/558, 564; 220/4 F, 220/354, 404, DIG. 6; 62/371, 457, 459

[56] References Cited

U.S. PATENT DOCUMENTS

| | | | |
|---|---|---|---|
| 2,610,472 | 9/1952 | Maxwell | 62/2 |
| 2,763,134 | 9/1956 | McDonald | 62/86 |
| 3,130,288 | 4/1964 | Monaco | 219/43 |
| 3,241,706 | 3/1966 | Monoco et al. | 206/558 |
| 3,710,589 | 1/1973 | Brown et al. | 62/371 X |
| 4,543,798 | 10/1985 | Page | 62/239 |
| 4,546,900 | 10/1985 | Lackey | 220/453 |

*Primary Examiner*—Allen M. Ostrager
*Attorney, Agent, or Firm*—Shlesinger & Myers

[57] ABSTRACT

A portable table top salad bar includes a collapsible base frame made from a plastic material for enclosing six foam or plastic inserts therein. The top opening of the inserts is closed by two dome-shaped lids which are made from a styrofoam or plastic material. A flexible vinyl liner is placed in the open space formed by the inserts for supporting salads and food items thereon. The liner includes a valve which opens to the exterior for draining-off water. The salad bar is constructed and arranged so as to be collapsed to one-half of its full size.

18 Claims, 2 Drawing Sheets

FIG. 2
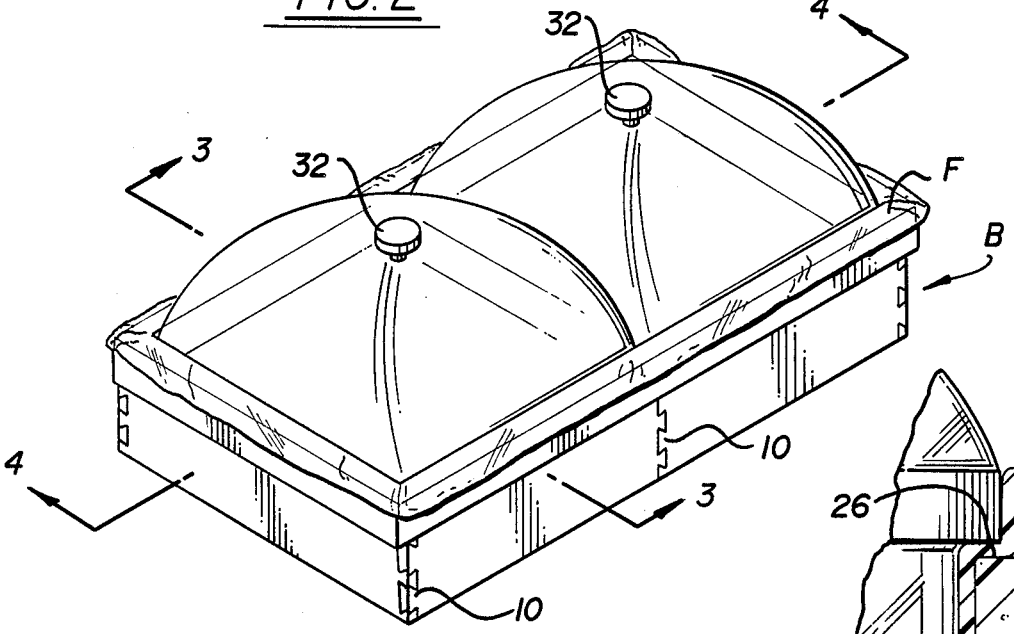
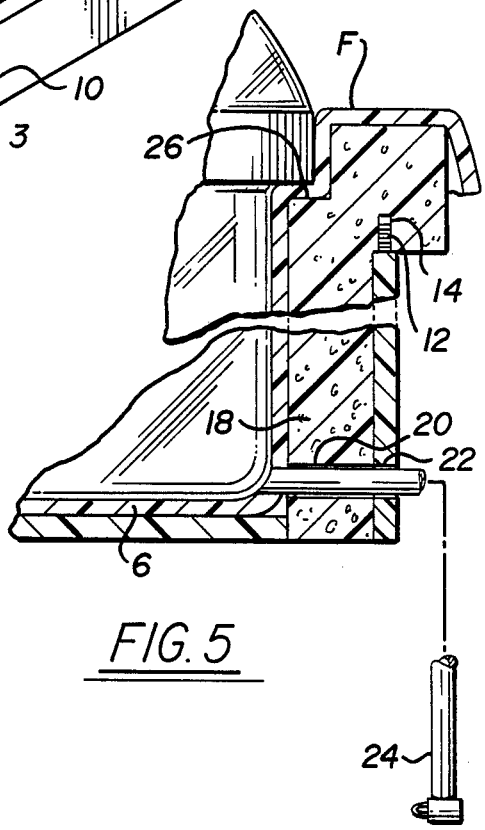
FIG. 5
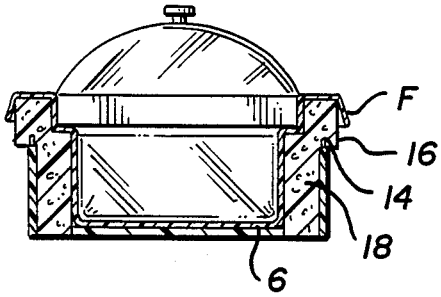
FIG. 3
FIG. 4
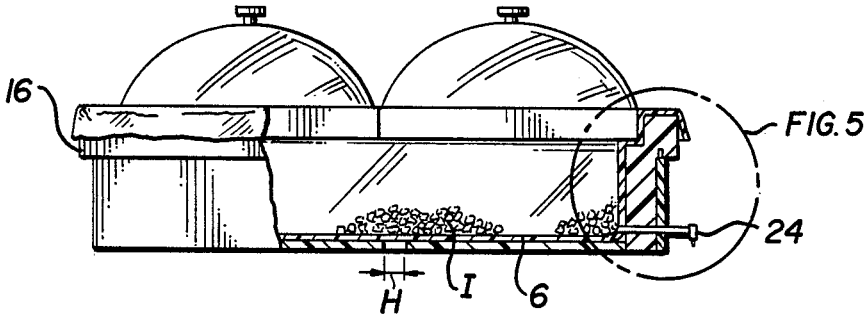

PORTABLE TABLE TOP SALAD BAR

BACKGROUND AND FIELD OF THE INVENTION

The present invention relates to a table top salad bar, which is portable and can be used to keep salads and other food items fresh on ice at parties and picnics.

Various serving trays for serving food items and the like have been devised as shown by U.S. Pat. Nos. 2,641,472 (Maxwell), 2,763,134 (McDonald), 3,130,288 (Monaco), 3,241,706 (Monaco), 3,710,589 (Brown), 4,543,789 (Page) and 3,546,900 (Lackey). The conventional food serving trays, however, suffer from disadvantage that food cannot be kept fresh for a long period of time. This is due to the fact that the conventional food serving trays do not have a provision for including ice or the like in order to keep the food items fresh. On the other hand, the food and salad serving stations provided at various restaurants, which do have the provision for including the ice are heavy, bulky and generally affixed to the building structure and cannot be transported from one place to another. In addition, the conventional portable food serving devices are not made of collapsible or folding parts and thus, take up substantial space during transportation.

OBJECTS AND SUMMARY OF THE INVENTION

It is an object of the present invention to provide a portable table top salad bar which is light-weight and easy to transport from one place to another.

It is another object of the present invention to provide a portable table top salad bar which includes collapsible portions for easy transport.

It is yet another object of the present invention to provide a portable table top salad bar which can be easily collapsed to one-half of its full size.

A further object of the present invention is to provide a portable table top salad bar which takes minimal space during transport.

It is a further object of the present invention to provide a portable table top salad bar which requires a small number of parts and is easy to assemble and disassemble.

A still further object of the present invention to provide a portable table top salad bar which keeps salads and other food items fresh for a substantially long period of time.

It is yet another object of the present invention to provide a portable table top salad bar which is inexpensive and easy to manufacture.

A further object of the present invention is to provide a portable table top salad bar which can be used during indoor as well as outdoor events, such as picnics and parties, to keep the food items and salads fresh for a substantially long period of time.

An additional object of the present invention is to provide a portable table top salad bar which is easy to clean and store.

In summary, the present invention provides a portable table top salad bar which can be used to keep the salads and other food items fresh for a substantially long period of time and which can be used during indoor as well as outdoor activities.

DESCRIPTION OF THE DRAWINGS

The above and other objects and advantages and novel features of the present invention will become apparent from the following detailed description of the preferred embodiment of the invention illustrated in the accompanying drawings, in which:

FIG. 2 is a perspective view of the portable table top salad bar in an assembled position;

FIG. 3 is a cross-sectional view taken along line 3—3 of FIG. 2;

FIG. 4 is a cross-sectional view taken along line 4—4 of FIG. 2; and FIG. 5 is a partial cross-sectional view enlarged to show the draining valve.

DETAILED DESCRIPTION OF THE INVENTION

Figure 1:
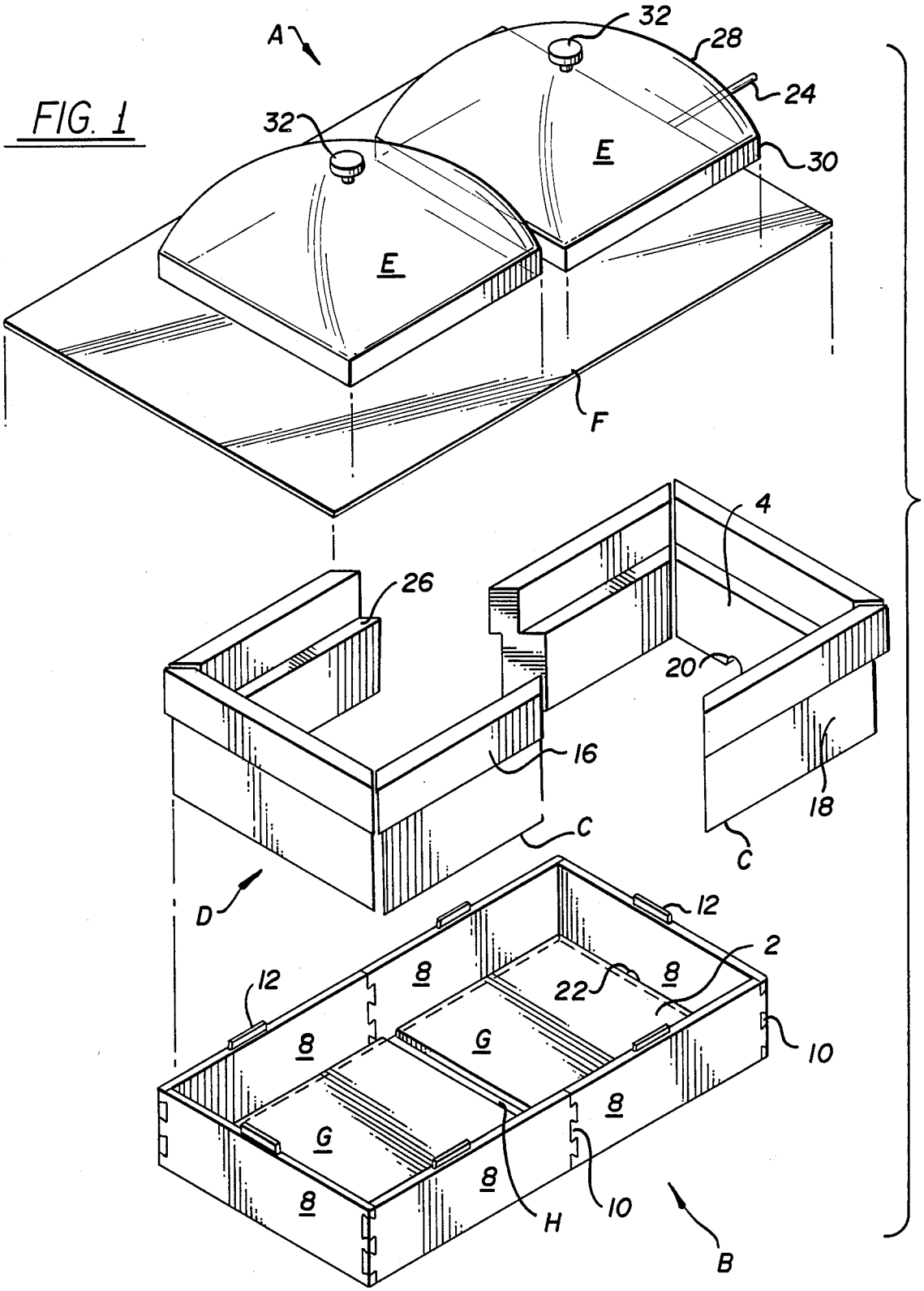
FIG. 1 is an exploded-perspective view of a portable table top salad bar according to the present invention.

As best shown in FIG. 1, the portable salad bar A of the present invention includes a base frame B for enclosing six foam inserts C in a space 2 thereof. The inserts C together form rim D which is snugly received in the space 2. The top opening 4 is closed by two dome-shaped lids E made from a foam, such as styrofoam, or plastic material. A flexible vinyl liner F is placed in opening 4 and atop rim D, and forms a bottom 6 for carrying food items and salads or the like. Two bottom sections G, substantially corresponding to the internal perimeter of rim D formed of foam inserts C, are placed within opening 4 for supporting bottom 6 of the vinyl liner F. The sections G may be made from a one-half inch thick foam or plastic material and are spaced apart from each other by a distance H, which is preferably about one and one-half inches.

The base frame B is made from sections 8, which are hinged at 10 to erect or collapse the base frame B. The sections 8 may be made from a suitable rigid material, such as plastic or wood, which is relatively stable and contributes to the overall structure of the salad bar A. Preferably, each section 8 is approximately thirty (30) inches long, eight (8) inches high and one-sixteenth (1/16) of one inch thick, and is detachably connected to other sections by hinges 10. The hinges 10 may be of multiple tongue-and-groove type and interlock the corresponding edges of two sections 8 to erect the base frame B. The base frame is open at top and bottom and defines space 2 for receiving the foam inserts C. Each section 8 may preferably include an upwardly extending projection 12, which is received into a corresponding recess 14 in the upper shoulder portion 16 of foam inserts C. The projections 12 may preferably be about three (3) inches long and one-half (½) inch tall, and impart additional stability to the salad bar in the fully assembled position.

The foam inserts C include lower support portion 18 which together correspond to the shape of the open space 2 of base frame B. In order to obtain a flush fit within space 2, the inserts C may be provided with mitered corners. This design further allows the user to collapse the salad bar A to one-half of its full size by placing one of the end inserts as the fourth and final insert in space H to construct the half-sized salad bar. As one of ordinary skill in the art would appreciate, in this embodiment, only four of sections 8 would be required to erect the base frame B, only one of bottom section G would be required to form a bottom support for the vinyl liner F, and only one lid F would be necessary to close the top opening 4.

One of the foam inserts C is provided with a hole 20, which is aligned with a hole 22 in one of the sections 4. Holes 20 and 22 are provided to receive a nozzle or valve 24 of liner F for draining-off any water formed due to ice I, or other alternative material conventionally used for keeping food items fresh. As best shown in FIG. 1, the foam inserts C further include a platform or ledge 26 along the internal surface thereof for supporting lids E thereon.

As best shown in FIG. 5, when foam inserts C are placed onto sections 8, projections 12 are snapped into corresponding recesses 14, thereby securely holding the rim D in space 2. In a preferred embodiment, upper shoulder portions 16 have a height of about two (2) inches and a thickness of about one inch.

As best shown in FIG. 1, lids E are dome-shaped and include an upper dome portion 28 and a lower vertical wall forming a skirt 30. The skirt 30 is substantially square-shaped such that when placed on platform or ledge 26, lids E completely close the top opening 4. Each lid E includes a knob or handle 32 positioned adjacent the peak of dome portion 28. As shown in FIG. 1, the lids E are made of a clear plastic material. However, lids D may, more preferably, be made from a foam, such as styrofoam, material.

USE AND ASSEMBLY

During use, sections 8 are interlocked about tongue-and-groove hinges 10 to obtain a self-standing frame. As shown in FIG. 1, the foam inserts C are placed in open space 2 alongside sections 8 such that projections 12 are received into recesses 14. Depending upon the need, one or both bottom sections G are placed in space 2 to support bottom 6 of liner F which is spread over the opening 4 such that a portion thereof extends over shoulder portions 16. A layer of ice I or a suitable material may then be placed over liner bottom portion 6. After setting the salads or other food items on top of the ice layer, the lids E may then be placed over it to store the food items therein. After a period of use, the valve or nozzle 24 in the liner F may be actuated to drain-off the water. However, one of ordinary skill in the art would appreciate that if dry ice is used, there may be no need to actuate the valve 24, as there will be no, or very little formation of water.

From the above, it can be seen that the salad bar of the present invention is easy to assemble for use and disassemble after the use, and is easily portable.

While this invention has been described as having a preferred design, it is understood that it is capable of further modifications, uses and/or adaptations of the invention and following in general the principle of the invention and including such departures from the present disclosure has come within known or customary practice in the art to which the invention pertains, and as may be applied to the central features hereinbefore set forth, and fall within the scope of the invention as limited by claims appended hereto.

What is claimed is:

1. A portable knock-down salad bar, comprising:

(a) a collapsible frame defining a perimeter support in the erected position;

(b) a plurality of inserts for positioning within said frame and forming a ring therein;

(c) said ring being open at top and having an internal periphery;

(d) said ring including a ledge extending about the internal periphery thereof;

(e) removable lid means cooperating with said ledge for closing the top opening of said ring; and (f) a liner positioned in the opening under said lid means.

2. The salad bar of claim 1, wherein:

(a) said frame is formed by a plurality of sections hinged to one another.

3. The salad bar of claim 1, wherein:

(a) said frame comprising a plurality of sections detachably connected to one another.

4. The salad bar of claim 1, wherein:

(a) said lid means comprising a lid having a perimeter substantially corresponding to the perimeter of said ledge.

5. The salad bar of claim 1, wherein:

(a) said lid means comprising at least one dome-shaped lid; and (b) said at least one lid is shaped so as to be received on said ledge.

6. The salad bar of claim 5, wherein:

(a) said at least one lid is made from a foam material.

7. The salad bar of claim 5, wherein:

(a) said at least one lid is made from a plastic material.

8. The salad bar of claim 1, wherein:

(a) said lid means comprising a dome-shaped lid; and (b) said lid including a handle for easy lifting thereof.

9. The salad bar of claim 1, wherein:

(a) said liner is formed of a flexible material so as to take the shape of said ring.

10. The salad bar of claim 9, wherein:

(a) said liner is a vinyl liner.

11. The salad bar of claim 1, wherein:

(a) said liner includes a valve means.

12. The salad bar of claim 11, wherein:

(a) said frame includes a first hole in a portion thereof; and (b) one of said inserts includes a second hole aligned with said first hole so that said valve means extends therethrough.

13. The salad bar of claim 1, wherein:

(a) at least one of said inserts is made of a plastic material.

14. The salad bar of claim 1, wherein:

(a) at least one of said inserts is made of a foam material.

15. The salad bar of claim 2, wherein:

(a) said sections are each made of a plastic material.

16. The salad bar of claim 2, wherein:

(a) said sections each having an upper edge and a lower edge:

(b) at least one of said sections including a projection extending upwardly from the upper edge thereof.

17. The salad bar of claim 16, wherein:

(a) at least one of said inserts including a recess for receiving said projection therein.

18. The salad bar of claim 1, further comprising:

(a) at least one bottom member positioned within said frame.

* * * * *